US006977344B2

(12) United States Patent
Tanaka

(10) Patent No.: US 6,977,344 B2
(45) Date of Patent: Dec. 20, 2005

(54) FLAT SHIELD CABLE

(75) Inventor: Atsuo Tanaka, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/775,143

(22) Filed: Feb. 11, 2004

(65) Prior Publication Data

US 2004/0154826 A1 Aug. 12, 2004

Related U.S. Application Data

(63) Continuation-in-part of application No. 10/305,939, filed on Nov. 29, 2002, now abandoned.

(30) Foreign Application Priority Data

Jan. 29, 2002 (JP) ..... 2002-020655

(51) Int. Cl.[7] ..... H01B 7/08
(52) U.S. Cl. ..... 174/117 F
(58) Field of Search ..... 174/36, 117 F, 174/117 FF

(56) References Cited

U.S. PATENT DOCUMENTS

| | | | | |
|---|---|---|---|---|
| 4,268,714 | A * | 5/1981 | Mori | 174/108 |
| 4,800,236 | A | 1/1989 | Lemke | |
| 5,737,470 | A | 4/1998 | Nagano et al. | |
| 6,225,556 | B1 * | 5/2001 | Saito | 174/36 |
| 6,261,683 | B1 | 7/2001 | Tanaka | |
| 6,444,902 | B1 | 9/2002 | Tsao et al. | |
| 6,531,658 | B2 | 3/2003 | Tanaka et al. | |

FOREIGN PATENT DOCUMENTS

JP A 06-084411 3/1994

* cited by examiner

*Primary Examiner*—Chau N. Nguyen
(74) *Attorney, Agent, or Firm*—Oliff & Berridge, PLC

(57) ABSTRACT

To provide a flat shield cable capable of increasing the strength against disconnection when the cable is bent in the width direction even if the conductor size of each signal line is reduced. A flat shield cable is characterized in that a drain line is provided on one side of a plurality of, parallel signal lines each having an insulating cover, a dummy line is provided on the other side of the signal lines, and the drain line, the signal lines, and the dummy line are covered with a shield tape, which is covered with an insulating sheath. Further, the shield tape includes a metal foil overlaying the lines, a polymer layer overlaying the metal foil, and an adhesive to securely attach the polymer layer to the insulating sheath. A method is provided to wrap the shield tape around the wires, press the shield tape and wires together, and cover them by the insulating sheath.

15 Claims, 3 Drawing Sheets

FLAT SHIELD CABLE

CLAIM FOR PRIORITY

The present invention is a Continuation-in-Part application of U.S. application Ser. No. 10/305,939 filed Nov. 29, 2002, which in turn claims priority to Japanese Application No. 2002-020655, filed on Jan. 29, 2002. The disclosures of these applications are herein expressly incorporated by reference in their entirety.

BACKGROUND OF THE INVENTION

1. Field of Invention

The present invention relates to a flat shield cable. In particular, the invention relates to a flat shield cable that is suitably used for electrical connection to electric equipment, etc. of vehicles such as automobiles.

2. Description of Related Art

In vehicles such as automobiles, many shield cables are used for electrical connection to electric equipment, etc. In recent years, flat shield cables have come to be used from the viewpoint of space saving, etc. FIG. 1 shows the structure of an exemplary conventional flat shield cable.

This conventional flat shield cable 1 has a flat structure in which a plurality of signal lines 2 each having an insulating cover and a drain line 3 are arranged parallel with each other and the signal lines 2 and the drain line 3 are covered with a shield layer 4, which is covered with an insulating sheath 5.

With this structure, external noise is interrupted by the shield layer 4 and led to an external ground via the drain line 3, whereby good signals are supplied to various kinds of electric equipment through the signal lines 2.

Incidentally, to improve the transmission characteristic (characteristic impedance) and reduce the weight, it is desired that the cross-sectional area (hereinafter also referred to as "conductor size") of the core conductor of each signal line 2 be as small as possible (e.g., 0.08 $mm^2$ or 0.13 $mm^2$). However, if the conductor size of each signal line 2 is reduced, the strength lowers to raise fear that a disconnection may occur in outside signal lines 2 when the cable 1 is bent in the width direction.

For example, in a flat shield cable in which two signal lines 2 and a drain line 3 are arranged parallel with each other and the conductor size of each signal line 2 is 0.08 $mm^2$, when bending stress is exerted on the flat shield cable 1 in the width direction to cause a bend, the core conductors of the outside signal line 2 is elongated by the bending. When the cable 1 is bent further, a disconnection occurs in the core conductor of the outside signal line 2. Break strength at that time was 53 N.

As described above, in the conventional flat shield cable 1, reducing the conductor size of each signal line 2 makes the cable 1 prone to a disconnection due to bending. This means a problem that wiring work needs to be conducted with sufficient care so as not to cause a bend.

Another problem encountered is the removal of the insulating sheath from the shield layer. In a conventional cable, the insulating sheath and the shield layers are adhered in a manner to inhibit removal, thus complicating repairs.

SUMMARY OF THE INVENTION

An object of the present invention is to solve the above problem in the art and thereby provide a flat shield cable capable of increasing the strength against disconnection when the cable is bent in the width direction even if the conductor size of each signal line is reduced.

To attain the above object, the present invention provides the following technical means:

A flat shield cable having a drain line is provided on one side of a plurality of parallel signal lines each having an insulating cover, and a dummy line is provided on the other side of the signal lines. In various exemplary embodiments, the drain line, the signal lines, and the dummy line are covered with a shield tape, which is covered with an insulating sheath.

In various exemplary embodiments, the flat shield cable includes the dummy line being made of a metal or an alloy. In additional embodiments, the flat shield cable includes the diameter of the dummy line being greater than the diameter of a core conductor of each of the signal lines. In further embodiments, the flat shield cable includes the insulating sheath and the shield layer can be easily separated.

In various exemplary embodiments, the shield tape of t he flat shield cable includes a metal foil, a polymer layer and an adhesive film, the metal foil being adjacent the signal lines, the drain line and the dummy line, the polymer layer adjacent to the metal foil, and the adhesive film being adjacent to the polymer layer. In additional embodiments, the insulating sheath is disposed adjacent to the adhesive film, wherein the plurality of signal lines, the drain line and the dummy line are co-planar, and the adhesive connecting the polymer layer and the insulating sheath to enable removal of the insulating sheath and the polymer layer together without also removing the metal foil.

In various exemplary embodiments, a method for producing a flat shield cable includes drawing a plurality of wires into a shield applying region, forming a shield tape that includes a metal foil, a polymer layer and an adhesive film, wrapping the shield tape around the plurality of wires to produce a wrapping, the metal foil of the shield tape being adjacent to the wires, pressing the wrap in the shield applying region to produce a shielded wire assembly, applying an insulating sheath to cover around the shielded wire assembly to produce the sheathed flat cable, the insulating sheath being joined to the polymer layer by the adhesive film, and cooling the sheathed flat cable.

In various exemplary embodiments, the method includes pressing the wrap between two oppositely rotating rollers. In additional embodiments, the method pressing between two oppositely rotating rollers, wherein one of the rollers includes a radial protrusion and the other of the rollers includes a complimentary radial recess forming the shield applying region.

DETAILED DESCRIPTION OF EXEMPLARY EMBODIMENTS

Figure 1:
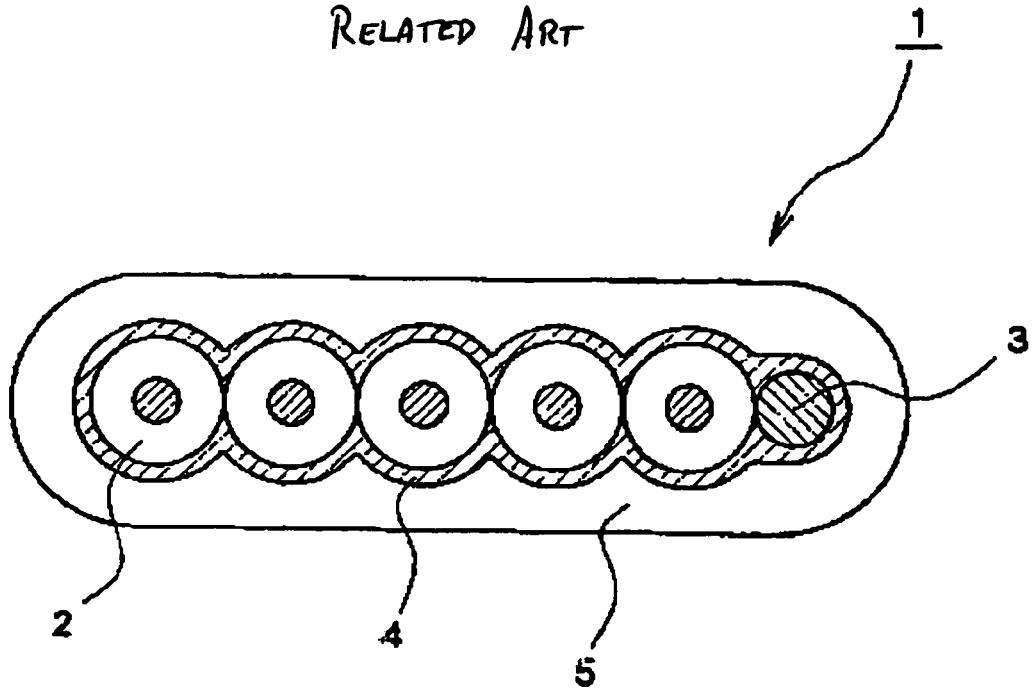
FIG. 1 is a sectional view showing the structure of an exemplary conventional flat shield cable.
Figure 2:
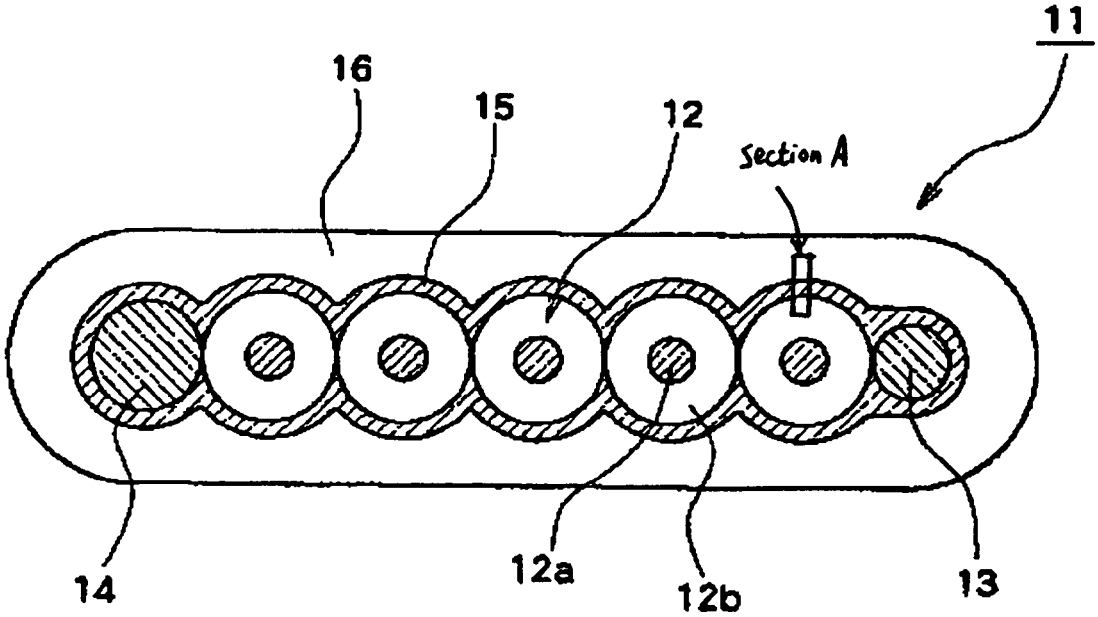
FIG. 2 is a sectional view showing the structure of a flat shield cable according to an embodiment of the present invention.

A preferred embodiment of the present invention will be hereinafter described. FIG. 2 shows the structure of a shield cable according to an embodiment of the invention.

The flat shield cable 11 according to this embodiment has a flat structure in which a drain line 13 is provided on one side of a plurality of (in this embodiment, five), parallel signal lines 12 each having an insulating cover and a dummy line 14 is provided on the other side in such a manner that the lines 12, 13, and 14 are arranged parallel with each other, and the lines 12, 13, and 14 are covered with a shield tape 15, which is covered with an insulating sheath 16. Each signal line 12 is composed of a core conductor 12*a* and an insulating cover 12*b*.

The outer diameter of each signal line 12 is set as appropriate so as to be suitable for a use, and is usually equal to about 1.27 to 1.40 mm. From the viewpoint of improving the transmission characteristic, it is preferable that the cross-sectional area (conductor size) of the core conductor 12*a* be about 0.05 to 0.08 $mm^2$. However, the invention is not limited to such a case. The core conductor 12*a* may be made of a metal or alloy material such as copper, aluminum, or tin-plated copper and may be either twisted wires or a single wire.

The insulating cover 12*b* of each signal line 12 may be made of any of various resin materials such as poly(vinyl chloride) (PVC), polyethylene (including a foaming type), halogen-free materials, and polytetrafluoroethylene. The thickness of the insulating cover 12*b* of each signal line 12 is set as appropriate in accordance with the conductor size of the core conductor 12*a*.

The number of parallel signal lines 12 can be set arbitrarily so as to be suitable for an appropriate use.

The drain line 13 is made of a metal or alloy material such as annealed copper or tin-plated copper and may be either twisted wires or a single wire. The conductor cross-section area of the drain line 13 is about 0.22 to 0.37 $mm^2$.

The dummy line 14 is provided to increase the strength and thereby prevent the core conductors 12*a* of the outside signal lines 12 from breaking when the flat shield cable 11 is bent in the plane of the greatest width. The dummy line 14 may be made of a metal or alloy material such as copper, aluminum, a copper alloy, or tin-plated copper and may be either twisted wires or a single wire.

From the viewpoint of increasing the strength, the conductor size of the dummy line 14 is preferably greater than that of each signal line 12; the conductor cross-section area of the dummy line 14 is about 0.22 to 0.37 $mm^2$. For example, when the conductor cross-section area of each signal line 12 is 0.08 to 0.13 $mm^2$, the conductor cross-section area of the dummy line 14 is preferably greater than or equal to 0.22 $mm^2$. Similarly, when the conductor cross-section area of each signal line 12 is 0.22 $mm^2$, the conductor cross-section area of the dummy line 14 is preferably greater than or equal to 0.37 $mm^2$.

The shield tape 15 is made of a material that exhibits a shielding effect. Specifically, the shield tape 15 may be made of copper foil/PET tape, tin-plated copper foil/PET tape, aluminum foil/PET tape, or the like, and has a combined thickness of about 15 to 21 $\mu$m.

Figure 3:
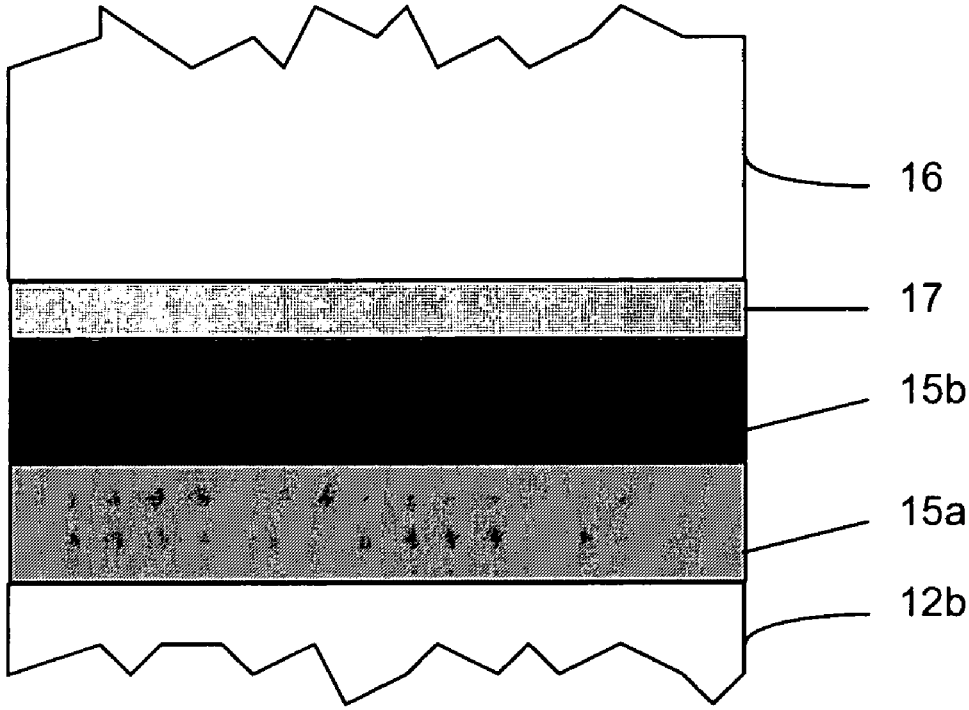
FIG. 3 is a sectional view showing the structure of an insulating sheath and shield tape according to an embodiment of the present invention.

FIG. 3 shows a detail cross-section of the shield tape 15 from the section region A in FIG. 2. In particular, the shield tape 15 includes a metal foil 15*a* and a polymer layer 15*b*, such as PET tape. The metal foil 15*a* may be made from copper, tin-plated copper or aluminum. Additionally, the shield tape 15 includes an adhesive film 17. The metal foil 15*a* overlays the insulating cover 12*b* of each signal line 12 for which a portion is shown in FIG. 3.

The polymer layer 15*b* overlays the metal foil 15*a*. The adhesive film 17 overlays the polymer layer 15*b*, while the insulating sheath 16 overlays the adhesive layer 17. Thus, the insulating sheath 16 and the polymer layer 15*b* are securely attached by the adhesive film 17 sandwiched between them. By tightly connecting the insulating sheath 16 and the polymer layered 15*b*, both layers 16 and 15*b* can be easily removed to facilitate access to the metal foil 15*a* without damaging the exposed foil. In contrast, the metal foil 15*a* and the polymer layer 15*b* are less securely attached to each other than provided by the adhesive film 17.

The metal foil 15*a* is preferably between 6 and 12 $\mu$m in thickness. Similarly, the polymer layer 15*b* is preferably between 6 and 12 $\mu$m in thickness. The adhesive film 17 is preferably between 1 and 3 $\mu$m in thickness. The combination of the metal foil 15*a*, the polymer layer 15*b* and the adhesive film 17 represent the shield tape 15. The shield tape 15 covers the plurality of signal lines 12, the drain line 13 and the dummy line 14.

The insulating sheath 16 is made of a material that is insulative, oil-resistant, and chemical-resistant. Resin materials, such as poly(vinyl chloride), polyethylene, halogen-free materials, and polytetrafluoroethylene may be used. The thickness of the insulating sheath 16 is about 0.3 to 0.4 mm.

In the case of a flat shield cable 11 in which a drain line 13 (conductor cross-section area: 0.22 $mm^2$), two signal lines 12 (conductor cross-section area: 0.08 $mm^2$), and a dummy line 14 (conductor cross-section area: 0.22 $mm^2$) are arranged parallel with each other, when bending stress was applied to the flat shield cable 11 in the width direction, no disconnection occurred in the core conductors 12*a* of the signal lines 12 though the dummy line 14 was broken at 73 N. The advantage of the invention was thus confirmed, by providing an increase in strength of about 38% over the background example.

By virtue of the employment of the above configuration, the invention can increase the strength against disconnection when the cable is bent in the width direction and hence can reduce the conductor size of each signal line and reduce the weight. Since a disconnection due to bending can be prevented effectively, wiring work is facilitated. Further, by virtue of the employment of the dummy line, the flat shield cable according to the invention has such a structure as to be hard to bend.

Figure 4:
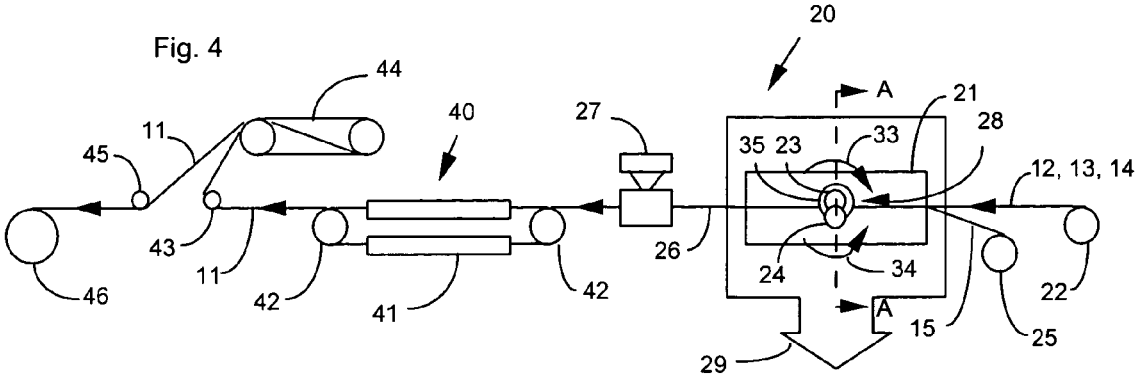
FIG. 4 is a block diagram view showing the steps for providing an insulating sheath and a shield tape according to an embodiment of the present invention.

FIG. 4 shows a block diagram of a method 20 to produce the flat shield cable 11 with signal lines 12, drain line 13 and dummy line 14 overlaid with the shield tape 15 and the insulating sheath 16. In particular, the shield applying apparatus 21 receives signal wires 12, drain wire 13 and dummy wire 14 from one or more wire supply spools 22. The wires are pressed to form a flat arrangement (as shown in FIG. 2) by an upper roller 23 and a lower roller 24. In addition, the shield tape 15 is provided by a shield supply spool 25 to the apparatus 21 for producing a shielded wire assembly 26.

After passing the shield applying apparatus 21, the wire assembly 26 is received in a sheath extruder 27. The insulating sheath 16 is applied to the shield tape 15 wrapped around the wires. The sheath extruder 27 then passes the resulting sheathed flat shield cable 11 out for spooling.

The shielded wire assembly 26 is produced by wrapping the shield tape 15 around the set of wires 12, 13 and 14 and pressing them together in a shield-applying region 28. The upper and lower rollers 23 and 24 impinge each other in the region 28. This roller operation process is shown in greater detail along rear view A—A in FIG. 5. The upper roller 23 is mounted to an upper shaft 31, while the lower roller 24 is mounted to a lower shaft 32. The upper roller 23 rotates in a clockwise direction 33 from the vantage shown in FIG. 4. In contrast, the lower roller 24 rotates in a counter-clockwise direction 34 from this vantage. Thus, the upper and lower rollers 23 and 24 rotate in opposite directions.

Figure 5:
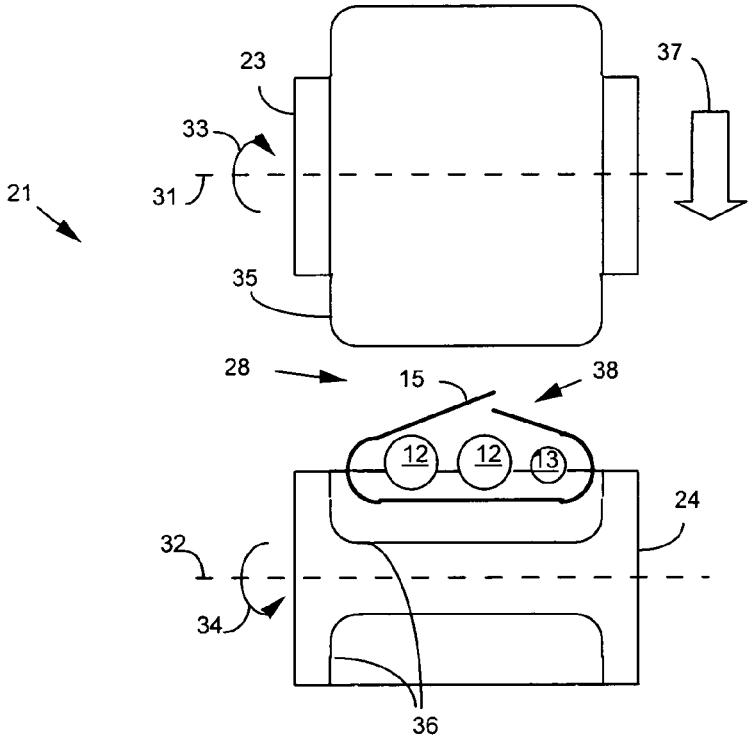
FIG. 5 is a block diagram showing details from view A—A in FIG. 4 for providing a shield tape according to an embodiment of the present invention.

FIG. 5 shows an elevation view A—A towards the right of FIG. 4 of the upper and lower rollers 23 and 24. The upper roller 23 includes a radial protrusion 35, while the lower roller 24 includes a complimentary radial recess 36, into which the radial protrusion 35 can be inserted. Both upper and lower rollers 23 and 24 are hot in order to fuse the shield tape 15 to the wires 12 and 13 that pass between the protrusion 35 and recess 36 in the region 28.

The upper roller 23 in FIG. 5 is shown vertically separated from the lower roller 24. However, during the pressing operation, the upper roller 23 is positioned in the direction of arrow 37 towards the lower roller 24. The shield tape 15 is wrapped around the wires 12 and 13 to form a wrap 38, which is then heated and pressed together between the protrusion 35 and the recess 36 in region 28.

Returning to FIG. 4, from the sheath extruder 27, the flat shield cable 11 passes to a spool system 40 to be cooled by a driving cooler 41 between tandem fore-and-aft conveyor rollers 42. The flat shield cable 11 is then diverted by a first divert roller 43 to a winding buffer 44 before proceeding to a second divert roller 45 and then wound onto a winding spool 46.

While this invention has been described in conjunction with the specific embodiments above, it is evident that many alternatives, combinations, modifications, and variations are apparent to those skilled in the art. Accordingly, the exemplary embodiments of this invention, as set forth above are intended to be illustrative, and not limiting. Various changes can be made without departing from the spirit and scope of this invention.

What is claimed is:

1. A flat shield cable comprising:

a plurality of parallel signal lines, each of the signal lines having an insulating cover, wherein an outer diameter of each signal wire is in a range of 1.27 mm to 1.40 mm, a cross-sectional area of a core conductor of each signal wire is in a range of 0.05 to 0.08 $mm^2$;

a drain line disposed on a first side of the signal lines;

a dummy line disposed on a second side of the signal lines, wherein the dummy line increases bending strength of the flat shield cable to prevent the signal lines from breaking;

a shield tape covering the signal lines, the drain line, and the dummy line, the shield tape including a metal foil, a polymer layer and an adhesive film, the metal foil being adjacent the signal lines, the drain line and the dummy line, the polymer layer adjacent to the metal foil, and the adhesive film being adjacent to the polymer layer; and an insulating sheath covering the shield layer and being adjacent to the adhesive film, wherein the plurality of signal lines, the drain line and the dummy line are co-planar, and the adhesive connecting the polymer layer and the insulating sheath to enable removal of the insulating sheath and the polymer layer together without also removing the metal foil.

2. The flat shield cable according to claim 1, wherein the dummy line is made of a metal or an alloy.

3. The flat shield cable according to claim 2, wherein a diameter of the dummy line is greater than a diameter of a core conductor of each of the signal lines.

4. The flat shield cable according to claim 2, wherein the metal or alloy is aluminum.

5. The flat shield cable according to claim 2, wherein the metal foil is made of one of copper, tin-plated copper or aluminum.

6. The flat shield cable according to claim 2, wherein the metal foil is 6 to 12 $\mu$m in thickness, the polymer layer is 6 to 12 $\mu$m in thickness, and the adhesive is 1 to 3 $\mu$m in thickness.

7. The flat shield cable according to claim 2, wherein a cross-section area of the dummy line ranges from 0.22 to 0.37 $mm^2$.

8. The flat shield cable according to claim 1, wherein a diameter of the dummy line is greater than a diameter of a core conductor of each of the signal lines.

9. The flat shield cable according to claim 8, wherein a diameter of the dummy line is greater than a diameter of the drain line.

10. The flat shield cable according to claim 3, wherein the metal foil is made of one of copper, tin-plated copper or aluminum.

11. The flat shield cable according to claim 8, wherein the metal foil is 6 to 12 $\mu$m in thickness, the polymer layer is 6 to 12 $\mu$m in thickness, and the adhesive is 1 to 3 $\mu$m in thickness.

12. The flat shield cable according to claim 8, wherein a cross-section area of the dummy line ranges from 0.22 to 0.37 $mm^2$.

13. The flat shield cable according to claim 1, wherein the metal foil is made of one of copper, tin-plated copper or aluminum.

14. The flat shield cable according to claim 1, wherein the metal foil is 6 to 12 $\mu$m in thickness, the polymer layer is 6 to 12 $\mu$m in thickness, and the adhesive is 1 to 3 $\mu$m in thickness.

15. The flat shield cable according to claim 1, wherein a cross-section area of the dummy line ranges from 0.22 to 0.37 $mm^2$.

* * * * *